United States Patent [19]

Yasuda et al.

[11] 4,456,848

[45] Jun. 26, 1984

[54] ULTRASONIC TRANSMITTING AND RECEIVING DEVICE

[75] Inventors: Eturo Yasuda; Shigeyuki Akita; Masao Kodera, all of Okazaki, Japan

[73] Assignee: Nippon Soken, Inc., Nishio, Japan

[21] Appl. No.: 357,617

[22] Filed: Mar. 12, 1982

[30] Foreign Application Priority Data

Mar. 16, 1981 [JP] Japan ..... 56-37429

[51] Int. Cl.[3] ..... H04R 17/10

[52] U.S. Cl. ..... 310/322; 179/110 A; 310/321; 310/332; 367/140

[58] Field of Search ..... 310/322, 324, 321, 332; 179/110 A; 367/140

[56] References Cited

U.S. PATENT DOCUMENTS 3,675,053 7/1972 Mifune et al. ..... 310/322

3,707,131 12/1972 Massa ..... 310/324

*Primary Examiner*—Richard A. Farley

*Attorney, Agent, or Firm*—Cushman, Darby & Cushman

[57] ABSTRACT

An ultrasonic transmitting and receiving device comprises a bimorph vibrator including two piezoelectric elements each connected electrically to the corresponding one of a plurality of terminals for receiving and delivering electric signals and a metallic member made of a thin metal plate and including a flat plate portion and a cylindrical portion extending from the circumferential periphery of the flat plate portion. The flat plate portion is placed between the piezoelectric elements and the cylindrical portion increases in outer diameter as it becomes distant from the flat plate portion.

4 Claims, 10 Drawing Figures

ULTRASONIC TRANSMITTING AND RECEIVING DEVICE

BACKGROUND OF THE INVENTION

The present invention relates to an ultrasonic transmitting and receiving device employing piezoelectric elements and suitable for use as an obstacle detector for automobiles.

DESCRIPTION OF THE PRIOR ART

Figure 1:
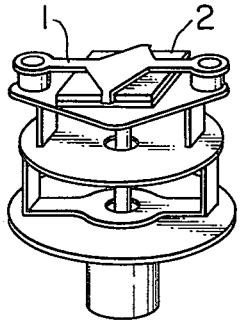
FIG. 1 is a perspective view showing a general construction of a prior art ultrasonic transmitting and receiving device.

One of ultrasonic transmitting and receiving devices heretofore known for use as obstacle detectors for automobiles is such that a square bimorph type vibrator 2 comprising two piezoelectric elements is crimped and supported by a phosphor bronze supporting plate 1 as shown in FIG. 1 so that an ultrasonic wave received by the supporting plate 1 is transmitted to the ultrasonic vibrator or piezoelectric unit 2 and a corresponding output is generated from the piezoelectric unit 2. Another of such devices is such that, as shown in FIG. 2, the nodal portion of a disk bimorph type vibrator 3 comprising two piezoelectric plates is fastened with an elastic adhesive to the central portion of a terminal strip 4 and a metallic conical resonator 7 is bonded to a coupling shaft 6 fitted in the central hole of the disk vibrator 3 whereby in response to the application of a specific ultrasonic signal the vibrator 3 vibrates in a flexure mode and the metallic resonator 7 causes the central portion of the vibrator 3 to vibrate greatly thereby generating a corresponding output across the ends of the vibrator 3.

The latter construction is better than the former since the former has the disadvantage of being considerably inferior in sensitivity to the latter in addition to the danger of the vibrator being shifted in its mount or slipping off the supporting plate or crimp plate 1 due to any external shock. However, where an ultrasonic transmitting and receiving device of the latter construction is used for example as a rear obstacle detecting devices for automobiles and mounted on the outside of the rear body portion of a vehicle, there is a disadvantage that when the vehicle undergoes steam car washing, for example, the car washing water entering via a horn is sprayed on the ultrasonic transmitting and receiving device so that even the ultrasonic transmitting and receiving device is positioned horizontally or downwardly, due to the surface tension the splashed water gathers as water drops between the vibrator 3 and the resonator 7 and/or between the resonator 7 and the coupling shaft 6 and this extremely deteriorates the wave transmitting and receiving sensitivity.

Figure 2:
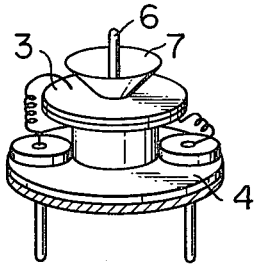
FIG. 2 is a perspective view showing a general construction of another prior art ultrasonic transmitting and receiving device.
Figure 3A:
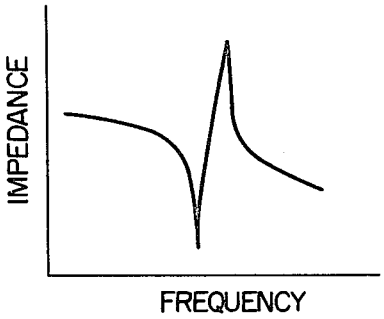
FIGS. 3A to 3C are diagrams useful in explaining the characteristics of the prior art ultrasonic transmitting and receiving device, FIG. 3A showing a frequency-impedance characteristic diagram, FIG. 3B a frequency-sensitivity characteristic diagram and FIG. 3C a synchronous waveform diagram of transmitted and received signals.
Figure 3B:
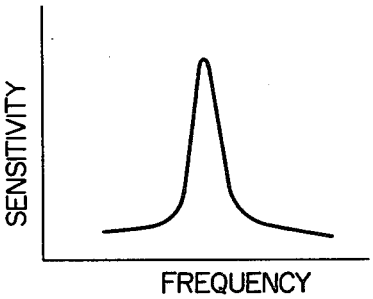
Figure 3C:
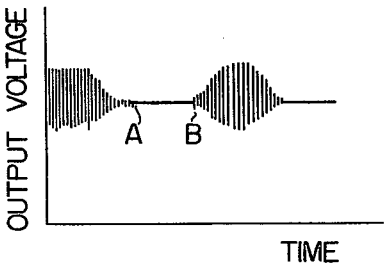

As will be seen from FIG. 2, the space between the vibrator 3 and the resonator 7 and the space between the resonator 7 and the coupling shaft 6 include an acute angle so that water drops gather there easily and in a large quantity and thus the wave transmitting and receiving sensitivity is deteriorated extremely. Moreover, the latter transmitting and receiving device utilizes the single-humped characteristic of the piezoelectric unit as shown in FIG. 3A so that its frequency band is very narrow and it can be provided with only a single-hump frequency-sensitivity characteristic as shown in FIG. 3B. Consequently, where the transmission and reception of ultrasonic pulses are effected by a single ultrasonic transmitting and receiving device to measure the distance to an object to be measured on the basis of the time from the transmission to the reception of a pulse, there is a disadvantage that even after the removal of an electric signal applied to the electrode to transmit ultrasonic pulses, the vibration of the vibrator 3 is not stopped in a short period of time and a damped vibration is continued as shown in FIG. 3C thus making it impossible to measure the distance of an object which is located a short way off. More specifically, in FIG. 3C, if the damped vibration lasts long, the termination of the damped vibration or a time A at which the transmitted signal extinguishes completely comes near to a time B at which a receiving signal arrives, and there happens in measurement of an object at a short distance the points A and B are superposed in the measurement of an object at a short distance and it is impossible to distinguish the received signal from the transmitted signal thus making the distance measurement impossible.

SUMMARY OF THE INVENTION

It is the primary object of the invention to provide an ultrasonic transmitting and receiving device which is so constructed that the gathering of water drops is prevented when the device is mounted in a horizontal or downward position, and which has a relatively flat sensitivity to frequencies and is capable of measuring the distance of an object located at a short distance.

According to the present invention there is provided an ultrasonic transmitting and receiving device comprising terminals for receiving and delivering electric signals, a bimorph vibrator comprising two piezoelectric elements each connected electrically to the corresponding one of the terminals and a metallic member made of a thin metal plate and including a flat plate portion placed between the piezoelectric elements and a cylindrical portion extending from the circumferential periphery of the flat plate portion.

DESCRIPTION OF THE PREFERRED EMBODIMENTS

The present invention will now be described with reference to the illustrated embodiments.

Figure 4:
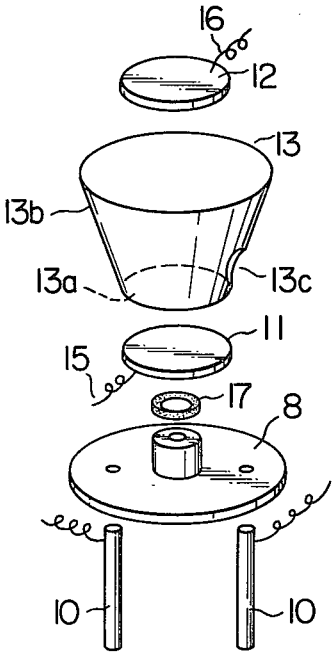
FIG. 4 is an exploded view showing the construction of an ultrasonic transmitting and receiving device according to an embodiment of the invention.

Referring to FIG. 4, there is illustrated an exploded view of an ultrasonic transmitting and receiving device according to an embodiment of the invention. In the Figure, a terminal strip 8 corresponds to the terminal strip 4 of FIG. 2 and terminals 10 are vertically fitted in and supported by the terminal plate 8. Numerals 11 and 12 designate disk-shaped piezoelectric elements which are combined opposite in residual polarization to each other thereby forming a bimorph type vibrator. A metallic member 13 is provided in place of the resonator 7 in the ultrasonic transmitting and receiving device of FIG. 2. The metallic member 13 is made of a thin metal plate and it comprises a flat plate portion 13*a* held between the piezoelectric elements 11 and 12 and a cylindrical portion extended from the circumferential periphery of the flat plate portion 13*a* and having a diameter which becomes larger gradually as it becomes more distant from the flat plate portion 13*a*. Numerals 15 and 16 designate lead wires for electrically connecting the piezoelectric elements 11 and 12 to the terminals 10 vertically fitted in the terminal strip 8. The cylindrical portion 13*b* of the metallic member 13 is formed with a hole 13*c* for bringing the lead wire 16 to the outside. The piezoelectric element 11 is attached to with an elastic adhesive 17 and supported by the central portion of the terminal strip 8 and the piezoelectric element 11 and the flat plate portion 13*a* of the metallic member 13 are cemented together with a conductive adhesive. The flat plate portion 13*a* and the piezoelectric element 12 are similarly cemented together. As a result, the bimorph vibrator used in this embodiment has a sandwich construction in which the piezoelectric elements are attached, in the opposite relation in residual polarization, to the respective sides of the flat plate portion of the thin metal plate. As shown in the Figure, the metallic member 13 is considerably large in external size as compared with the vibrator 7 shown in FIG. 2. The diameter of the flat plate portion 13 is at least equal to the diameter of the bimorph vibrator formed by the piezoelectric elements 11 and 12 and the distance over which the cylindrical portion 13*b* extends from the flat plate portion 13*a* is also large. The cylindrical portion 13*b* of the metallic member 13 spreads in a socalled funnel form in space, and in a similar manner to the metallic vibrator 7 of FIG. 2 the cylindrical portion 13*b* serves as a vibration diaphragm which provides an improved impedance matching between the air and the piezoelectric unit as well as a sound collecting effect, owing to its funnel shape, with an increase in the received sound pressures.

With the construction described above, by virtue of the fact that the coupling shaft 6 and the metallic vibrator 7 of FIG. 2 which have heretofore been the main cause of the gathering of water drops are eliminated, that between the components there is no longer any space including an acute angle and that the cylindrical portion 13*b* of the metallic member 13 is formed into a funnel shape, even if water enters, the water will flow out to the outside from the ultrasonic transmitting and receiving device when mounted horizontally or downwardly, thus greatly reducing the possibility of the water drops being gathered. Although there is the possibility that water drops stick to the joint between the circumferential periphery of the piezoelectric element 12 and the flat plate portion 13*a* of the metallic member 13, the thickness of the piezoelectric elements 11 and 12 is in the order of 0.2 to 0.3 mm so that the amount of the spattered water drops is very small and the resulting effect on the sensitivity of the piezoelectric elements is almost negligible.

With the ultrasonic transmitting and receiving device of this invention, when an ac electric signal is applied to the vibrator via the terminals 10, an ultrasonic pulse signal is transmitted through the vibration of the bimorph type vibrator of the sandwich construction. When the ultrasonic signal arrives at an object to be measured so that it is reflected from the object and the reflected ultrasonic signal is applied to the vibrator, the bimorph type vibrator starts to vibrate in a flexural mode and the bending increases in magnitude due to the action of the metallic member 13 provided for the purposes of providing an impedance maching between the bimorph type vibrator and the air. As mentioned previously, the cylindrical portion 13*b* of the metallic member 13 spreads outwardly in a funnel form and thus it has a sound collecting effect thus contributing to increasing the output. The bimorph type vibrator which is now bending in a greater degree generates an electric charge across its ends and the charge is delivered from the terminals 10 via the lead wires 15 and 16.

Figure 5A:
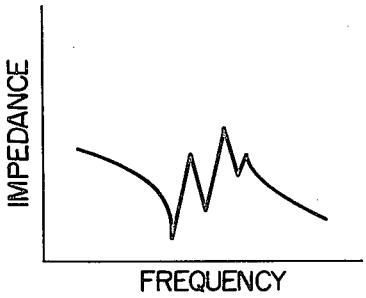
FIGS. 5A to 5C are diagrams useful in explaining the characteristics of the ultrasonic transmitting and receiving device according to the embodiment of the invention shown in FIG. 4, FIG. 5A showing a frequency-impedance characteristic diagram, FIG. 5B a frequency-sensitivity diagram and FIG. 5C a synchronous waveform diagram of transmitted and received signals.
Figure 5B:
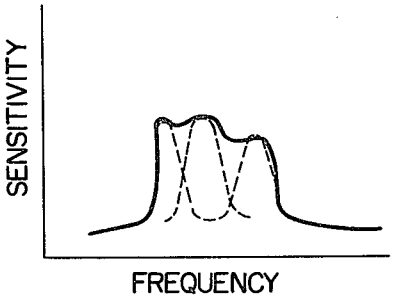
Figure 5C:
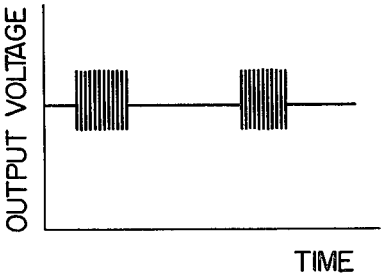

Regarding the frequency characteristic of the ultrasonic transmitting and receiving device according to the present embodiment, a plurality of resonance points are involved as shown in FIG. 5A and thus a relatively flat sensitivity characteristic is exhibited as shown in FIG. 5B. In other words, in contrast to the conventional frequency characteristic which has a single resonance point and is thus a single-hump frequency characteristic exhibiting a high sensitivity at a particular frequency (see FIGS. 3A and 3B), a characteristic involving a plurality of resonance points as in the case of the present embodiment has a rather flat sensitivity since a plurality of single-hump frequency characteristics are superposed one upon another. As a result, while, in the case of the conventional characteristic, the damped vibration of the piezoelectric unit lasts for a long time due to the reverberation of the resonance even after the removal of the electric signal, with a characteristic involving a plurality of resonance points as the present embodiment the removal of the electric signal causes the resonances to interrupt one another and thus the damped vibration is extinguished in a very short period as shown in FIG. 5C. As a result, a short-distance measurement is made possible.

The appearance of a plurality of resonance points in this embodiment has been confirmed by experiments. Such an appearance is considered owing to the fact that the external size of the metallic member 13 serving as a vibration diaphragm is considerably large as compared with the resonator 7 of FIG. 2, that the flat plate portion 13*a* of the metallic member 13 is placed between the piezoelectric elements 11 and 12 so that the vibration caused by the sound pressure transmitted to the piezoelectric elements 11 and 12 is transmitted from around the piezoelectric elements 11 and 12 and so on.

Figure 6:
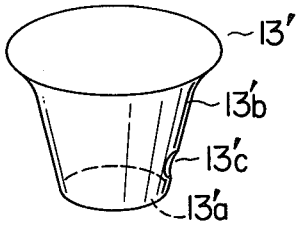
FIG. 6 is a perspective view of a metallic member in an ultrasonic transmitting and receiving device according to another embodiment of the invention.

FIG. 6 is a perspective view of a metallic member 13' used in an ultrasonic transmitting and receiving device according to another embodiment of this invention. The metallic member 13' has a cylindrical portion 13'*b* whose forward end or open end with a relatively large outside diameter is gradually curved outwardly. As a result, a greater sound collecting effect is ensured and the output is increased.

From the foregoing description of preferred embodiments it will be apparent that in accordance with the present invention there is provided an ultrasonic transmitting and receiving device which does not almost involve a danger of water drops sticking, ensures an improved sound collecting effect resulting in an increase in the output, and is capable of reducing the damping time of a transmitted signal making it possible to measure the distance of an object located a short way off.

We claim:

1. An ultrasonic transmitting and receiving device comprising:

a plurality of terminals for receiving and delivering electric signals;

a bimorph vibrator including two piezoelectric elements each connected electrically to a corresponding one of said terminals; and a metallic member made of a thin metal plate and including a flat plate portion placed between said piezoelectric elements and a cylindrical portion extending from a circumferential periphery of said flat plate portion.

2. A device according to claim 1, wherein said cylindrical portion has an outer diameter increasing as it becomes distant from said flat plate portion.

3. An ultrasonic transmitting and receiving device comprising:

a plurality of terminals for receiving and delivering electric signals;

a terminal strip supporting said terminals;

a disk-type bimorph vibrator fixedly attached with an elastic adhesive into said terminal strip, said vibrator including two piezoelectric elements connected electrically to said terminals respectively; and a metallic member made of a thin metal plate and including a flat plate portion placed between said piezoelectric elements and a cylindrical portion extending from a circumferential periphery of said flat plate portion and increasing in outer diameter as it becomes distant from said flat plate portion.

4. A device according to claim 1, 2 or 3, wherein said cylindrical portion of said metallic member includes a forward end gradually curved outwardly.

* * * * *